US005662529A

United States Patent [19]

Hashimoto

[11] Patent Number: 5,662,529

[45] Date of Patent: Sep. 2, 1997

[54] COMBINED LIGHTER AND GOLFER'S GRIP TRAINING DEVICE

[76] Inventor: Shoei Hashimoto, 150, Ootaki, Fukuoka-machi, Nishitonami-gun, Toyama-ken 939-01, Japan

[21] Appl. No.: 641,941

[22] Filed: May 2, 1996

[51] Int. Cl.[6] ..... A63B 69/36; F23D 11/36

[52] U.S. Cl. ..... 473/203; 473/220; 431/145; 431/156; 431/346

[58] Field of Search ..... D27/141; 431/144, 431/145, 346, 156; 472/203, 201, 202, 204, 206, 282, 294, 300, 220

[56] References Cited

U.S. PATENT DOCUMENTS 2,121,718 6/1938 Sweetland ..... 473/203
2,212,353 8/1940 Rosby ..... D27/141 X
4,836,544 6/1989 Lai ..... 473/203 X
5,348,467 9/1994 Piffath et al. ..... 431/156 X

*Primary Examiner*—George J. Marlo
*Attorney, Agent, or Firm*—Flynn, Thiel, Boutell & Tanis, P.C.

[57] ABSTRACT

A golf training tool for mastering grips includes a base lighter and a tip lighter, each being a gripping body equipped with an ignition unit therein, wherein a male connector and a female connector which is fitted onto the male connector not rotatably are formed at the upper and lower ends of the base and tip lighters respectively, and a finger touching portion is formed uneven on the outer surfaces thereby conforming to the basic grip of fingers when they are connected to each other. As a result, it is possible to provide a golf training tool for mastering grips which is convenient to carry and can be also used as lighters.

9 Claims, 7 Drawing Sheets

COMBINED LIGHTER AND GOLFER'S GRIP TRAINING DEVICE

BACKGROUND OF THE INVENTION

1. Field of the Invention

This invention relates to a golf training tool for mastering grips which can be also used as lighters or cases for accommodating lighters.

2. Description of the Related Art

A grip is the most important of the fundamentals of playing golf. If a player grips a golf club loosely or in a wrong direction, he cannot swing the club well however well he intends to do. It is said that if the player makes light of practicing the grip, he remains as a poor player for a long time. Accordingly, the use of a golf training tool for mastering grips is recommended, particularly to a beginner.

A conventional golf training tool for mastering grips has been long-rod-shaped and made of plastic, the gripping portion of which is formed uneven so as to conform to the gripping shapes of both hands. Since the gripping portion is concave where fingers should touch the same, a player swings the tool while gripping the gripping portion so as to fit his hands to the basic grip. Accordingly, he can master the basic grip as a natural result of gripping it many times.

Since the conventional golf training tool for mastering the basic grips which is integrally formed, heavy and long-rod-shaped as described above is inconvenient to carry, it is usually placed at home and a player usually practices the grip by gripping it when he finds time. However, since many players cannot find time, it is very convenient if he can practice the grip also in a commuter train.

On the other hand, since the lighter is small-sized enough to carry, a regular smoker always bears in mind to put it in his pocket and he feels much inconvenience if he forgets it. Further, in the case of a disposable lighter, some of them are contained in accommodating cases to safely cover the cylinder of a lighter body in each of them.

SUMMARY OF THE INVENTION

In view of the facts as described above, it is an object of the invention to provide a golf training tool for mastering grips which is convenient to carry and can be also used as lighters.

To attain the aforementioned object, a golf training tool for mastering grips according to a first aspect of the invention is composed of a base lighter and a tip lighter, each having a gripping body equipped with an ignition unit therein, wherein a male connector and a female connector which is fitted onto the male connector in a non-rotatable matter are formed at the upper and lower ends of gripping bodies of the base and tip lighters respectively so that both lighters may be connected to each other in series, and a finger touching portion is formed undulatingly on the outer surface of the gripping bodies conforming to the basic grip of fingers when they are connected to each other.

In the golf training tool for mastering grips, the gripping bodies may be the accommodating tanks of ignition liquid.

Further, the ignition units may be disposable lighters and the gripping bodies may be the accommodating cases receiving the disposable lighters therein.

Further, a projecting wall may be provided at the upper end of each gripping body to surround the back of the ignitor of the ignition unit of the lighter, and the projecting wall may be provided together with the male connector in the base lighter.

A golf training tool for mastering grips according to a second aspect of the invention is a gripping body which comprises an ignitor at the upper end thereof and a finger touching portion formed undulatingly on the outer surface thereof conforming to a basic grip of fingers.

Since the golf training tool for mastering grips having the above structure is almost equal in weight and size to a lighter, different from the conventional one having no hollow portion therein, is not inconvenient to carry, and since the gripping body is gripped every time it is used as a lighter, the frequency of practice can be increased without intentionally trying to do so.

There are basic forms of grips such as an overlapping grip, an interlocking grip, a base ball (natural) grip, etc. A finger touching portion is formed extending over both gripping bodies to fit one or two of the basic forms according to the first aspect of the invention. Since two gripping bodies are connected together to form a long tool, it is possible to form the finger touching portion fitted to any of such basic forms of grips. Further, since both accommodating cases are connected to each other in a nonrotatable fashion, it is possible to surely obtain not only a basic square grip by which a golf ball is driven straight (at a direction perpendicular to the golf club) and a slice grip causing a weak grip by which the trajectory of a ball curves right, but also a hook grip causing a strong grip by which the trajectory of a ball curves left.

DESCRIPTION OF THE PREFERRED EMBODIMENTS

First Embodiment: (FIGS. 1 to 6)

A first embodiment of the present invention will be now described with reference to FIGS. 1 to 6.

Figure 1:
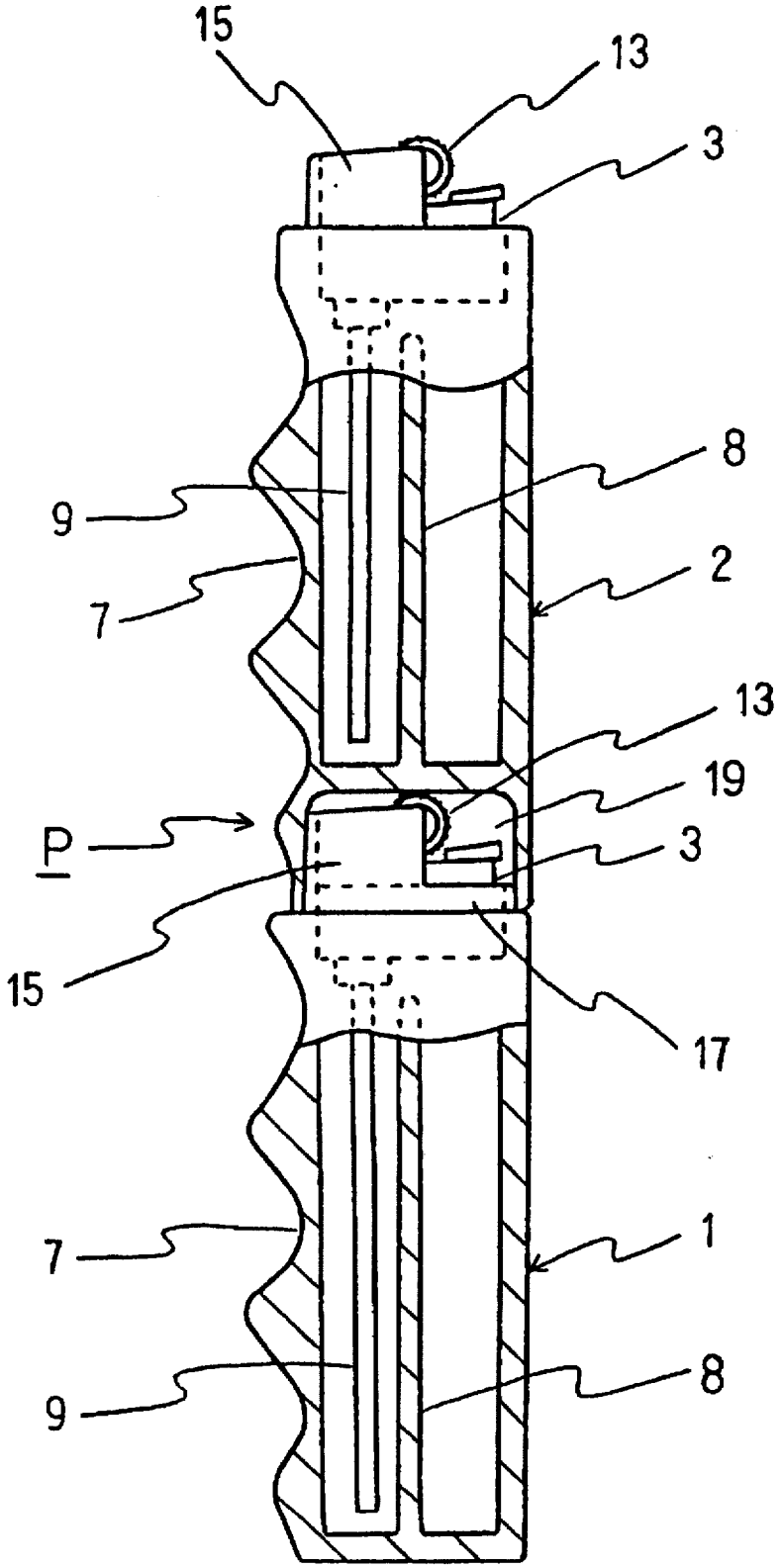
FIG. 1 is a longitudinal cross sectional view of a golf training tool for mastering grips according to a first embodiment of the present invention viewed from a side thereof in the state of being assembled.
Figure 2:
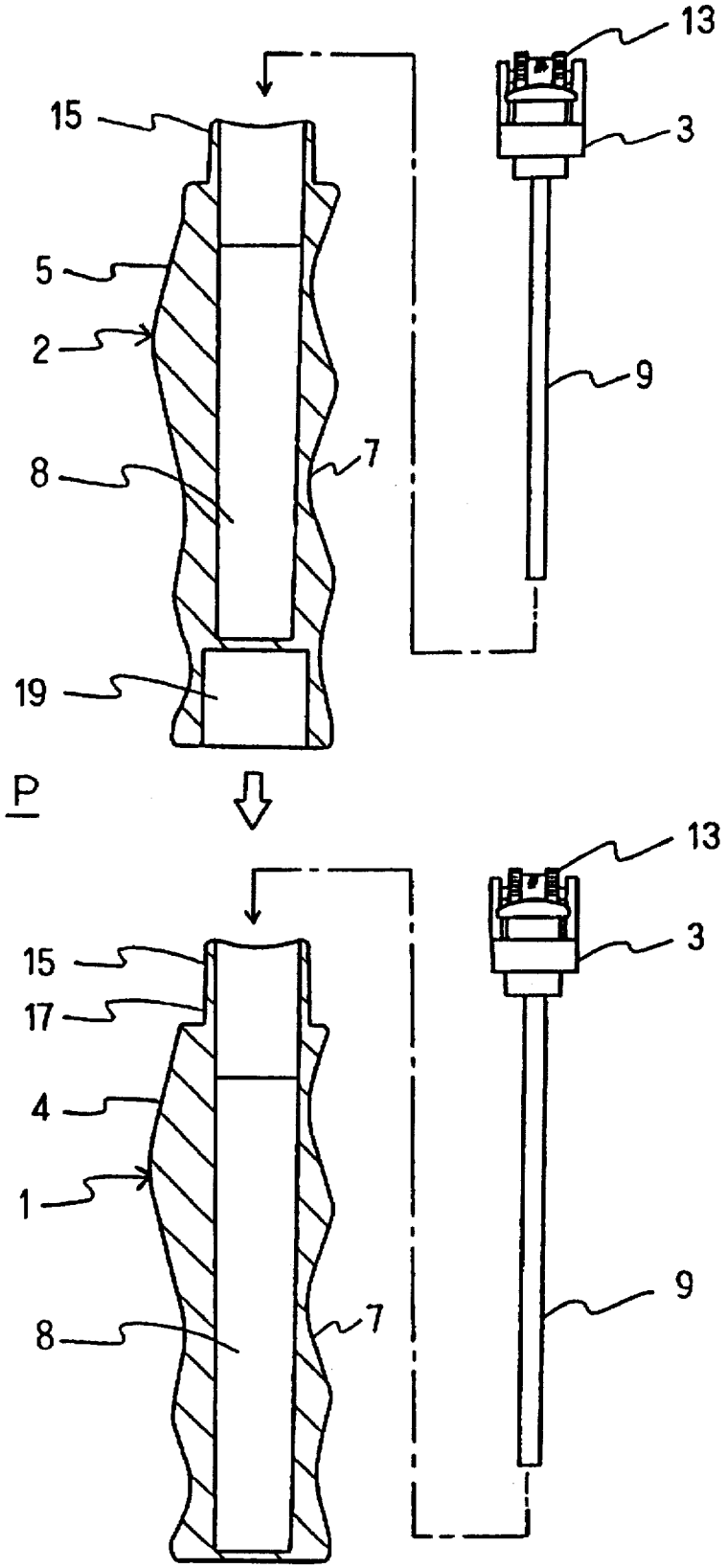
FIG. 2 is a longitudinal cross sectional view of the golf training tool for mastering grips viewed from the front thereof in the state of being disassembled.
Figure 3:
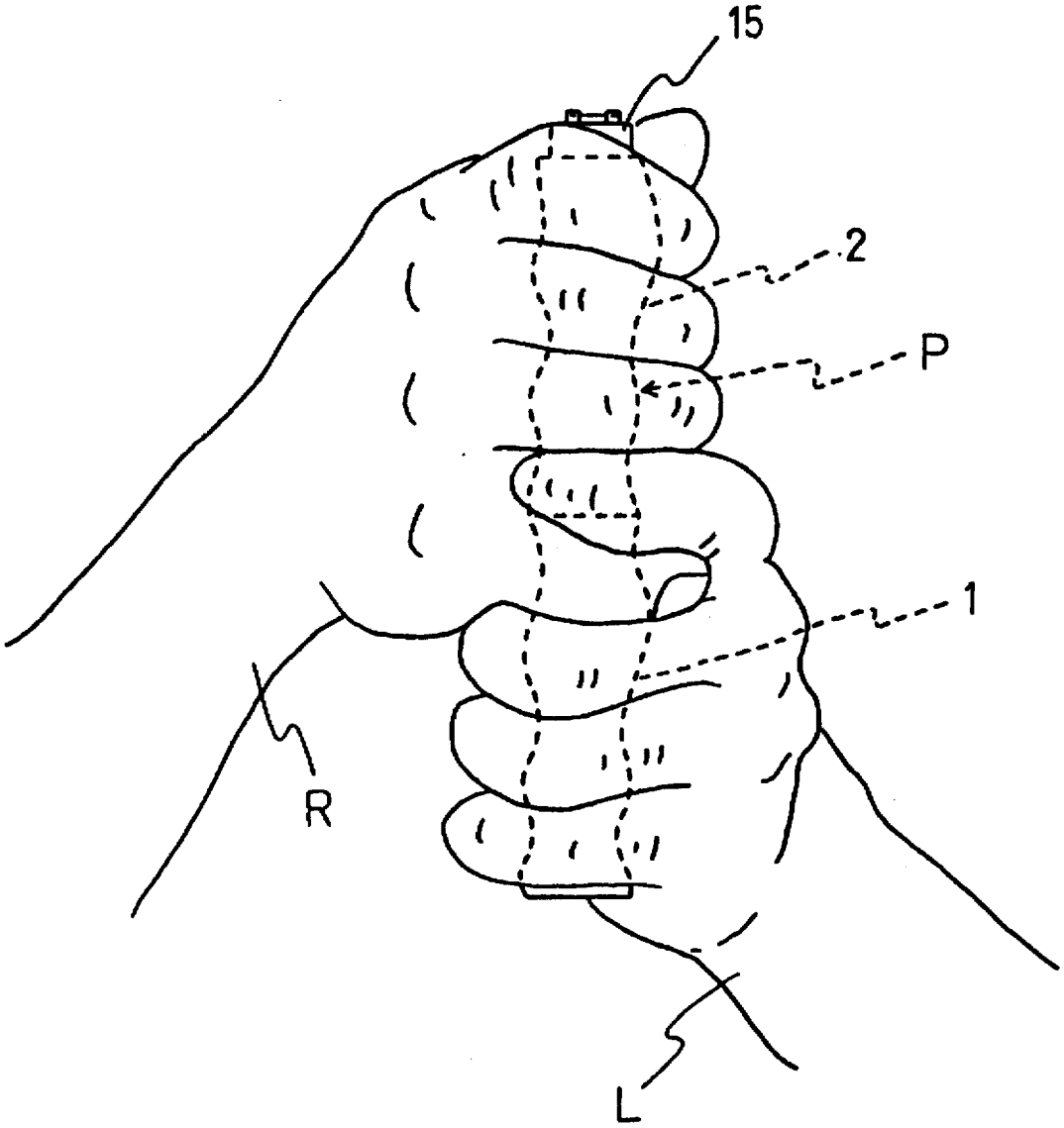
FIG. 3 is a perspective view of the golf training tool for mastering grips in the state of being used.
Figure 4:
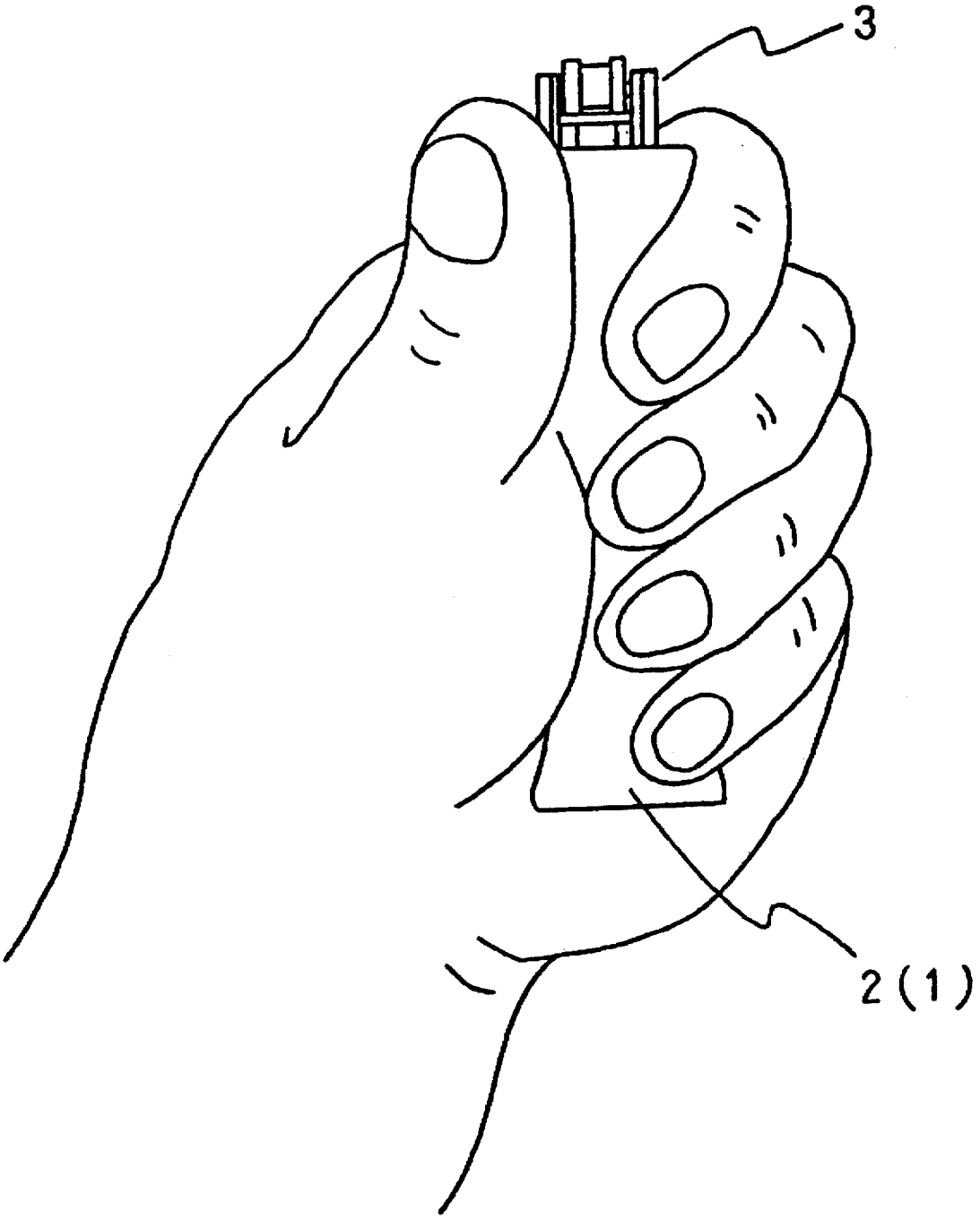
FIG. 4 is a perspective view of the golf training tool for mastering grips in another state of being used.

FIGS. 1 to 6 relate to the first embodiment of the present invention wherein FIGS. 1 and 2 show an example and FIGS. 3 and 4 show it in use. The golf training tool for mastering grips P is composed of a base lighter 1 and a tip or upper lighter 2, wherein an ignition unit 3 is integrally incorporated in each of gripping bodies 4 and 5, and the base lighter 1 and tip lighter 2 can be connected to each other by way of the gripping body 4 and gripping body 5.

The gripping body 4 of the base lighter 1 has a finger touching portion 7 formed as recesses on the outer periphery thereof, the finger touching portion 7 being gripped by a left hand L usually positioned lower and the gripping body 5 of the tip lighter 2 has the other finger touching portion 7 similarly formed as recesses on the outer periphery thereof. The finger touching portion 7 being gripped by a right hand R usually positioned above the left hand L. Each of the finger touching portions 7 and 7 includes a tank therein for accommodating ignition liquid and comprises a partition wall 8 formed therein.

A projecting wall 15 for surrounding the back of an ignitor 13 of the ignition unit 3 protrudes from the upper tip end of each of the gripping bodies 4 and 5, and a male connector 17 including the projecting wall 15 is formed at or protrudes from the upper tip end of the gripping body 4 of the base lighter 1, and a female connector 19 which is fitted onto the male connector 17 is formed at or recessed in the lower tip end of the gripping body 5 of the tip lighter 2. When the male connector 17 is connected to or received in the female connector 19, the finger touching portions 7 and 7 are connected together in series to form a gripping portion for both hands similar to that of an ordinary golf training tool for mastering grips.

The ignitor 13 which constitutes the main portion of the ignition unit 3 is fitted in and bonded to the upper tip end of each of the gripping bodies 4 and 5 to be incorporated thereto, and a pipe 9 is vertically provided under and to the ignitor 13 for jetting gas from the ignition liquid thereto.

In this embodiment, the shape of the finger touching portion 7 is adjusted to an overlapping grip or an interlocking grip. FIG. 3 shows a state where the golf training tool for mastering grips is used for the overlapping grip. Since the projecting wall 15 protrudes from the upper tip end of the gripping body 5 of the tip lighter 2, when a player grips the golf training tool in such manner that the projecting wall 15 comes behind the hand gripping the tip lighter 2 when viewed from the front thereof, he can grip the golf training tool correctly for practicing a correct swing guided by the projecting wall 15.

Further, it is also possible to master a grip by gripping either of the lighters, i.e., the lighter 2 (or 1) as shown in FIG. 4.

Figure 5:
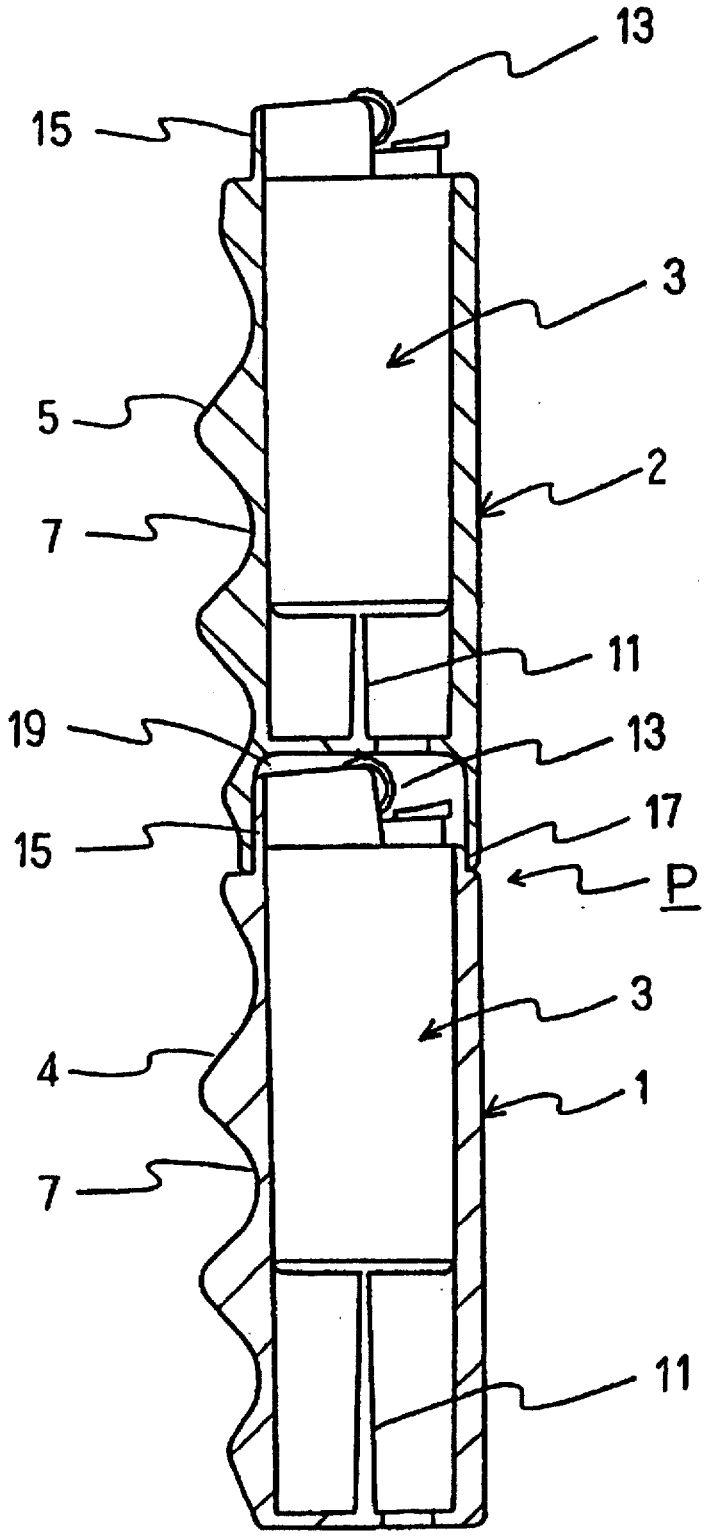
FIG. 5 is a longitudinal cross sectional view of a golf training tool for mastering grips according to a modified first embodiment of the present invention viewed from a side thereof in the state of being assembled.
Figure 6:
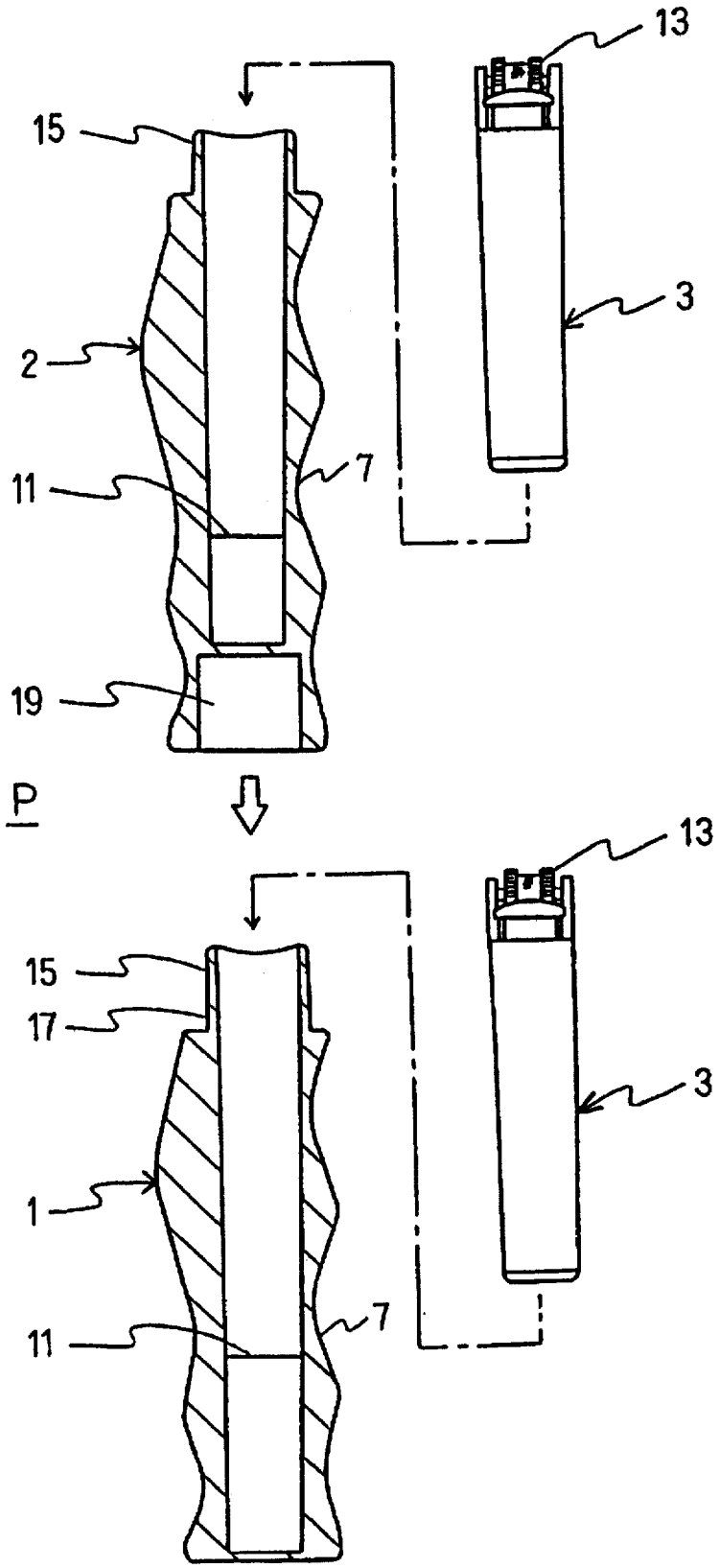
FIG. 6 is a longitudinal cross sectional view of the golf training tool for mastering grips in FIG. 5 viewed from the front thereof in the state of being disassembled.

FIGS. 5 and 6 show a modified first embodiment of the present invention. In this case, though a golf training tool for mastering grips P is composed of a base lighter 1 and a tip lighter 2 like the above embodiment, the ignition units 3 and 3 of the base and tip lighters 1 and 2 are disposable lighters which can be also used alone and gripping bodies 4 and 5 are the hollow lighter accommodating cases receiving the disposable lighters therein. Further, a short lighter is used as each of the ignition units 3 to reduce weight, and a lighter base 11 is provided at the lower tip end portion of each of the gripping bodies 4 and 5.

Other portions are substantially the same as those of the above embodiment, i.e., a finger touching portion 7 and a projecting wall 15 are provided on each of the griping bodies 4 and 5, and a male connector 17 together with the projecting wall 15 and a female connector 19 are formed at the gripping body 4 of the base lighter 1 and at the gripping body 5 of the tip lighter 2 respectively. This embodiment is the same as the above embodiment (refer to FIGS. 3 and 4) and is also used in the same manner.

Figure 7:
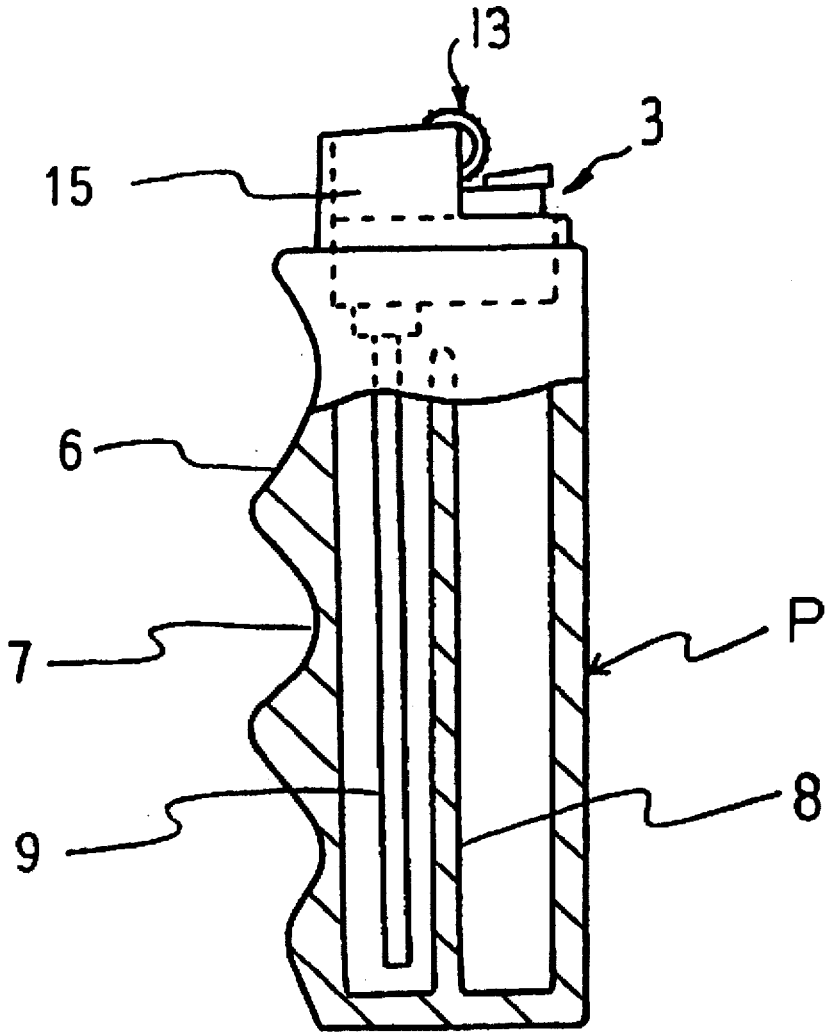
FIG. 7 is a longitudinal cross sectional view of a golf training tool for mastering grips according to a second embodiment of the present invention viewed from a side thereof.

Second Embodiment (FIG. 7)

FIG. 7 shows an example of a second embodiment of the present invention, wherein an ignition unit 3 is fitted in a gripping body 6 to be incorporated thereto and the ignitor 13 thereof protrudes from the upper tip end of the gripping body 6. In this case, though the gripping body 6 and the ignition unit 3 are integrally formed, the ignition unit 3 as a disposable lighter may be detachably inserted into the gripping body 6 as shown in FIGS. 5 and 6.

As described above, since the golf training tool for mastering grips of the invention is almost equal in weight and size to a lighter, and is different from the conventional golf training tool having no hollow portion, it is not inconvenient to carry and can be carried in a pocket like a lighter, so that a player can practice a grip, for example, in a commuter train or during a walk, and can use his time effectively. As a result, he can become a skillful golf player in a short time, even if he is busy. Further, there are excellent effects that since the gripping body is gripped when it is used as a lighter, the frequency of practice can be increased without intentionally trying to do so, which inevitably speeds up the mastering of the grip. Still further, users may consider it to be an elegant accessory.

In the case of the assembling type, it can be disassembled to be compact for the convenience of portability, even if it is for use with both hands.

In addition to that, when the projecting wall for surrounding the back of the ignitor is provided, the connection between the base and tip lighters are reinforced thereby and, further, it is possible to practice a correct swing by gripping the gripping bodies guided by the projecting wall.

What is claimed is:

1. A golf training tool for mastering grips comprising a base lighter and a tip lighter, each having a gripping body equipped with an ignition unit therein, said base lighter having a male connector, said tip lighter having a female connector, said male connector being fixedly receivable in said female connector so that said base and tip lighters are connected to each other in series, each gripping body having an outer surface conforming to a basic golf grip of fingers when said base and tip lighters are connected to each other, and said outer surfaces having a plurality of grooves for receiving fingers therein which are generally axially aligned when said base and tip lighters are connected together.

2. A golf training tool for mastering grips according to claim 1, wherein said gripping bodies have tanks for storing ignition liquid therein.

3. A golf training tool for mastering grips according to claim 1, wherein said gripping bodies are hollow, and said ignition units are disposable lighters receivable in said hollow gripping bodies.

4. A golf training tool for mastering grips according to claim 1, wherein said ignition unit has an ignitor, and wherein each said gripping body has a projecting wall at an upper end thereof adjacent a back portion of said ignitor, and said projecting wall being a portion of said male connector in said base lighter.

5. The golf training tool according to claim 1, wherein said male and female connectors are integrally formed with respective said gripping bodies and said outer surfaces.

6. A golf training tool for mastering grips comprising a gripping body having a lighter, said lighter including an ignition unit at an upper end of said gripping body, an outer surface, and a finger touching portion formed by a plurality of grooves in said outer surface conforming to a finger positioning in a basic golf grip.

7. A golf training tool and lighter combination comprising, an elongate upper lighter having an ignition unit at a first end thereof, a receiving connector at a second end thereof, and an outer surface configured into a golf-grip shape for receiving a hand of a user thereon in a golf-grip, an elongate base lighter having an ignition unit and a protruding connector at one end thereof, and an outer surface configured into a golf-grip shape for receiving a hand of a user in a golf grip, said protruding connector being received in said receiving connector thereby securing said upper lighter and said base lighter together.

8. The golf training tool and lighter combination according to claim 7, wherein each said outer surface has a finger engaging portion, said finger engaging portions being axially aligned when said upper and base lighters are secured together.

9. The golf training tool and lighter combination according to claim 7, wherein said ignition unit is a disposable lighter, and wherein said upper and base lighters have hollow interiors receiving said ignition unit therein.

* * * * *